US008234805B2

(12) United States Patent
Dukes et al.

(10) Patent No.: US 8,234,805 B2
(45) Date of Patent: Aug. 7, 2012

(54) SIGN FIXTURE

(75) Inventors: Gary A. Dukes, Minneapolis, MN (US); Jeremy A. Clark, Minneapolis, MN (US); David H. Cheney, Saint Paul, MN (US); James W. Kostka, Minnetonka, MN (US)

(73) Assignee: Target Brands, Inc., Minneapolis, MN (US)

( * ) Notice: Subject to any disclaimer, the term of this patent is extended or adjusted under 35 U.S.C. 154(b) by 216 days.

(21) Appl. No.: 12/780,491

(22) Filed: May 14, 2010

(65) Prior Publication Data

US 2011/0277363 A1 Nov. 17, 2011

(51) Int. Cl.
*G09F 7/04* (2006.01)

(52) U.S. Cl. ..... 40/600; 40/611.01; 248/206.5

(58) Field of Classification Search ..... 40/607.01, 40/660, 600, 661.01; 248/432, 188; 211/DIG. 1
See application file for complete search history.

(56) References Cited

U.S. PATENT DOCUMENTS

| | | | | | |
|---|---|---|---|---|---|
| 2,557,262 | A | * | 6/1951 | Cordes | 211/191 |
| 2,876,359 | A | | 3/1959 | Plymale | |
| 3,296,725 | A | * | 1/1967 | Fenwick | 40/660 |
| 3,497,081 | A | | 2/1970 | Field | |
| 3,608,741 | A | | 9/1971 | Schray | |
| 3,703,964 | A | | 11/1972 | Field | |
| 4,190,167 | A | | 2/1980 | Wells et al. | |
| 4,472,897 | A | * | 9/1984 | Phillips | 40/352 |
| 4,531,472 | A | * | 7/1985 | Marrero et al. | 116/28 R |
| 4,618,063 | A | | 10/1986 | Mendenhall | |
| 4,677,780 | A | | 7/1987 | Shuman | |
| 4,776,116 | A | | 10/1988 | Shuman | |
| 4,960,258 | A | | 10/1990 | Stocker et al. | |
| 5,381,991 | A | | 1/1995 | Stocker | |
| 5,388,359 | A | * | 2/1995 | DeWitt | 40/607.14 |
| 5,472,163 | A | | 12/1995 | Callas | |
| 5,609,317 | A | * | 3/1997 | Glynn et al. | 248/206.5 |
| 5,664,749 | A | | 9/1997 | Kump et al. | |
| 6,006,678 | A | | 12/1999 | Merit et al. | |
| 6,381,890 | B1 | | 5/2002 | Sjostedt | |
| 6,685,037 | B1 | | 2/2004 | Zadak | |
| 2002/0166275 | A1 | | 11/2002 | Broadwell et al. | |

* cited by examiner

*Primary Examiner* — Lesley D Morris
*Assistant Examiner* — Kristina Junge
(74) *Attorney, Agent, or Firm* — Merek, Blackmon & Voorhees, LLC

(57) ABSTRACT

A sign fixture includes a support beam, a sign holder and at least one H-bracket. The support beam having a first end and a second end and supported by a product display structure. The sign holder supports a sign indicative of information related to a product displayed for sale. The at least one H-bracket includes a magnet to magnetically couple a first portion of the support beam to a first portion of the sign holder.

20 Claims, 9 Drawing Sheets

SIGN FIXTURE

BACKGROUND

Retail establishments use a variety of types and sizes of product display structures or units to present products to customers for purchase. These product display structures both support the product for display and can indicate the product price. Example product display structures include shelves, racks, peg hooks and other similar structures.

Signs are used on product display structures to highlight products displayed for sale. For example, signs can emphasize the price of the displayed product or bring the displayed product to the attention of the customer because it was advertised in a certain media format, such as a catalog, a circular or a commercial. These signs are supported on sign fixtures and can be attached to the product display structures.

The discussion above is merely provided for general background information and is not intended to be used as an aid in determining the scope of the claimed subject matter.

SUMMARY

A sign fixture includes a support beam attachable to an underlying product display structure, a sign holder and at least one H-bracket coupling the sign holder to the support beam. The sign holder supports a sign indicative of information related to a product displayed for sale. The at least one H-bracket includes a magnet that extends through a thickness of a lateral member of the H-bracket to magnetically couple a portion of the support beam to a portion of the sign holder. The components for attaching the support beam to the underlying production display structure are adjustable, making the sign fixture useable with a variety of different product display structures.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include a sign fixture having components for supporting a sign indicative of information related to a product displayed on a product display structure and components for coupling the sign fixture to the product display structure. The sign fixture includes a metallic support beam for mating with the product display structure, a metallic sign holder and at least one bracket having a magnet for coupling the sign holder to the support beam. The sign fixture is adjustable such that the same sign fixture can be used to engage with multiple different product display structures regardless of their arrangement or size.

Figure 1:
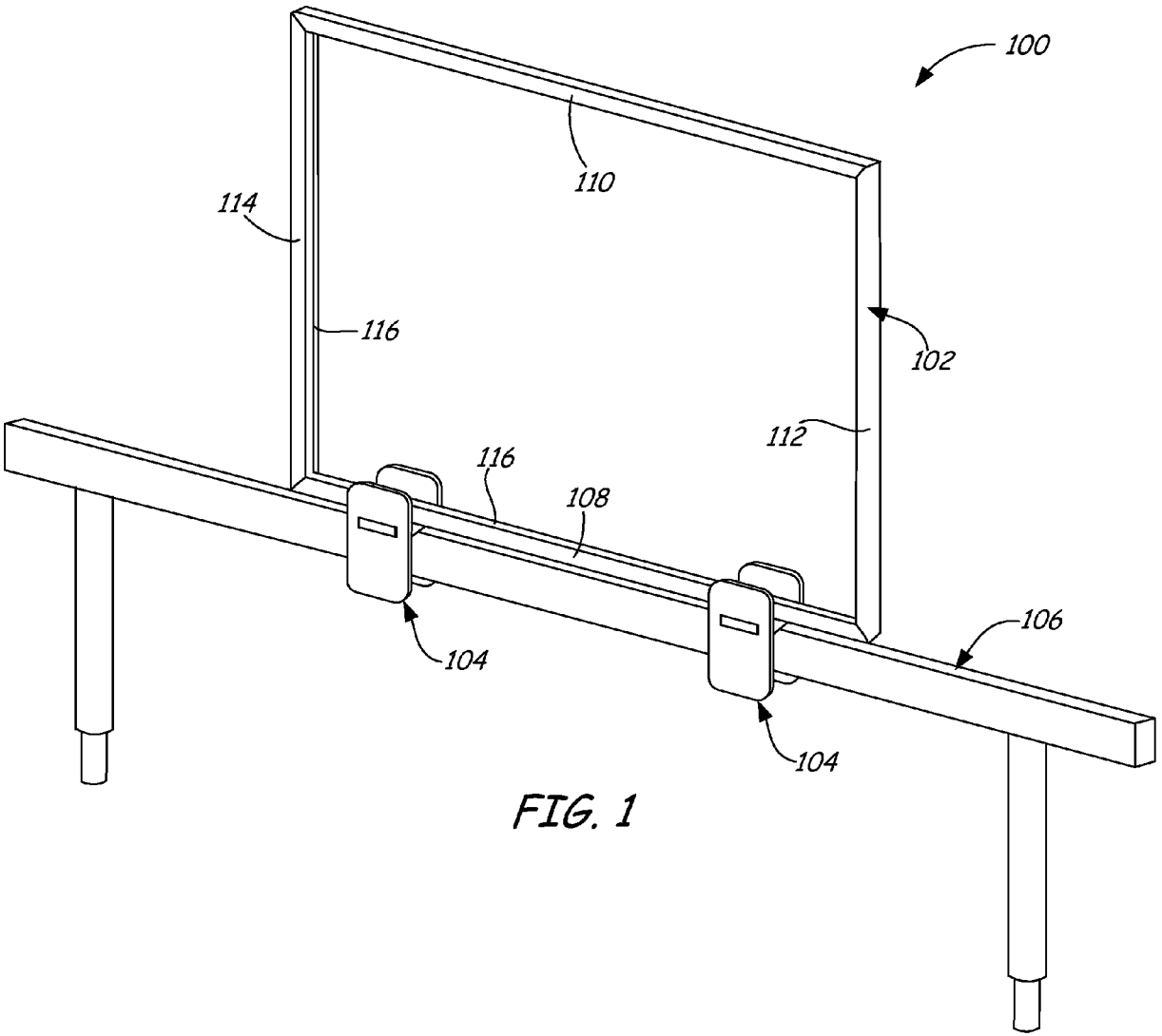
FIG. 1 is a perspective view of an exemplary sign fixture under one embodiment.

FIG. 1 illustrates a perspective view of an exemplary sign fixture 100 under one embodiment. Sign fixture 100 includes a metallic sign holder or frame member 102 mounted with at least one removable bracket or H-bracket 104 (of which FIG. 1 illustrates two brackets 104) to an underlying metallic support beam or bar 106 supportable by a product display structure in a retail store, such as a rack, shelf, table or other structure. Sign holder or frame member 102 includes a bottom 108, a top 110, a first side 112 and a second side 114. Each of bottom 108, top 110 and sides 112 and 114 includes interior facing channels 116 for receiving edges of a sign (not illustrated).

Figure 2A:
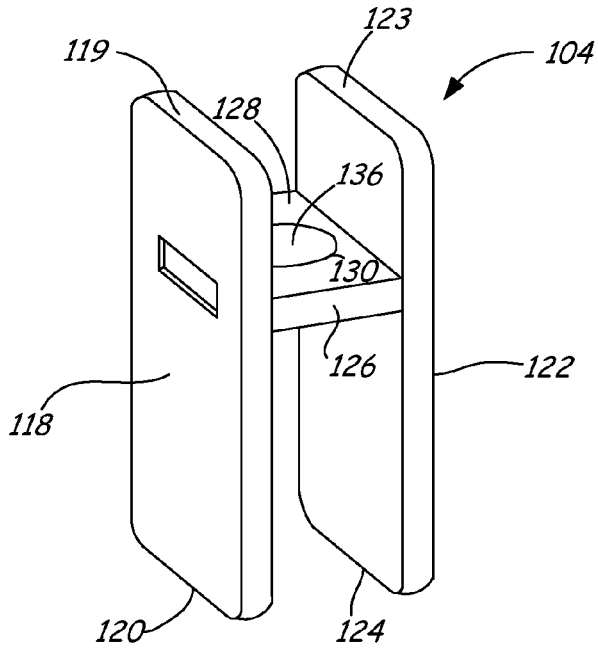
FIGS. 2A-2C illustrates a perspective view, a side view and a top view of the bracket illustrated in FIG. 1.
Figure 2B:
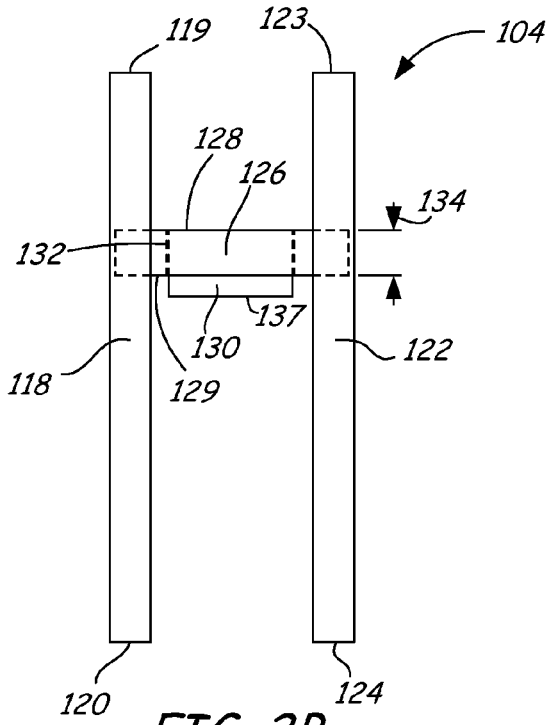
Figure 2C:
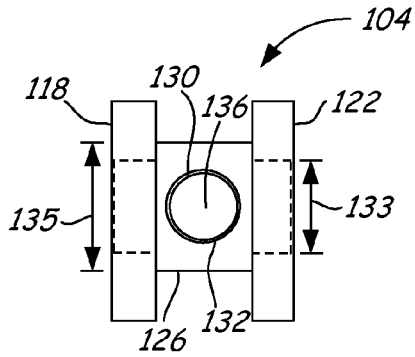

FIGS. 2A-2C illustrate a perspective view, a side view and a top view of the bracket or H-bracket 104 for the sign fixture illustrated in FIG. 1. Bracket 104 includes a first longitudinal member or element 118 having a first end 119 and a second end 120 and a second longitudinal member or element 122 having a first end 123 and a second end 124. Longitudinal members 118 and 119 are oriented substantially parallel relative to each other. Bracket 120 also includes a lateral member or element 126. Lateral member 126 includes a top surface 128 and a bottom surface 129 and is attached to and extends perpendicularly between first and second longitudinal members 118 and 122 at a location between the first ends 119 and 123 and second ends 120 and 124.

As illustrated in dashed lines in FIG. 2C, lateral member 126 includes two widths. A first width 133 of lateral member 126 extends widthwise and lengthwise within both longitudinal members 118 and 122 a distance less than a width and a thickness of the longitudinal members. A second width 135 of lateral member 126 extends widthwise and lengthwise between the longitudinal members 118 and 122. The second width of lateral member 126, as illustrated in FIGS. 2B and 2C, includes an aperture 132 (shown in dashed lines in FIG. 2B) that extends between top surface 128 and bottom surface 129 of lateral member 126.

Aperture 132 of bracket 104 holds and accommodates at least one cylindrical magnet 130. Therefore, magnet 130 extends through a thickness 134 of lateral member 126 and has a top end 136 and a bottom end 137. The top end 136 of magnet 130 is exposed to and aligned with the top surface 128 of lateral member 126. The bottom end 137 of magnet 130 protrudes from bottom surface 129 of lateral member 126.

Figure 3A:
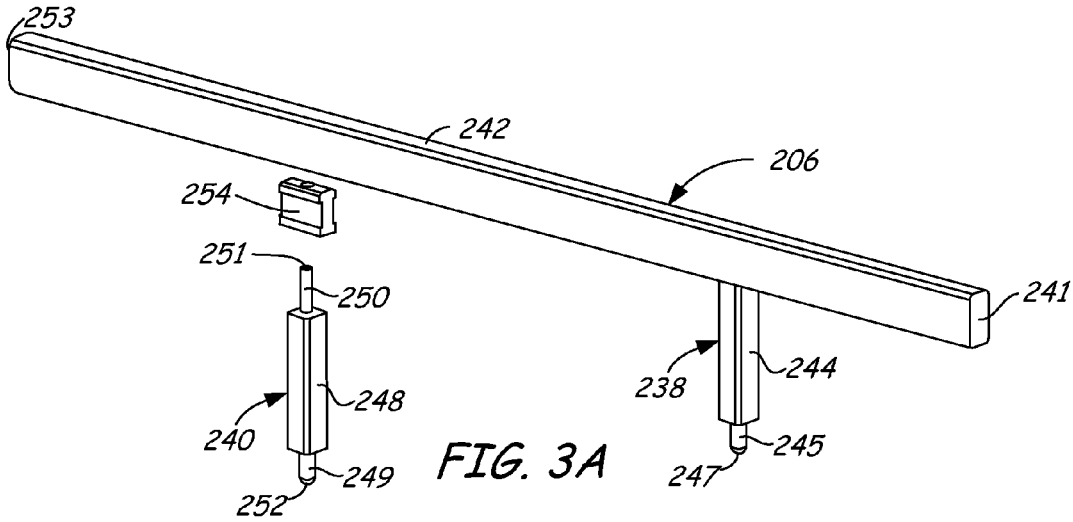
FIGS. 3A-3C illustrate an exploded perspective view, an assembled side view and assembled bottom view of a support beam and posts of a sign fixture under one embodiment.
Figure 3B:
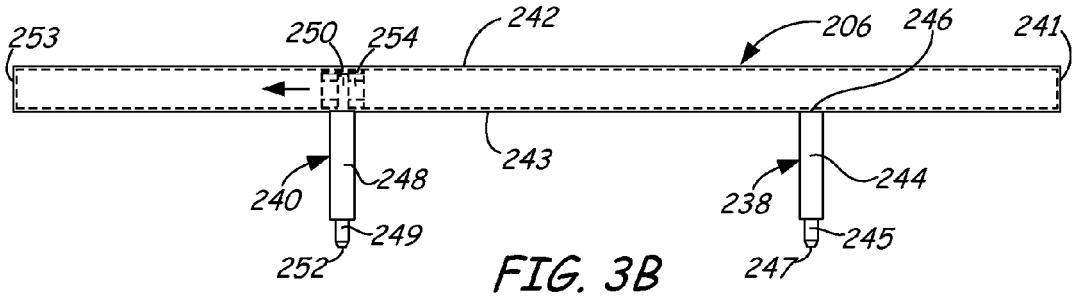
Figure 3C:
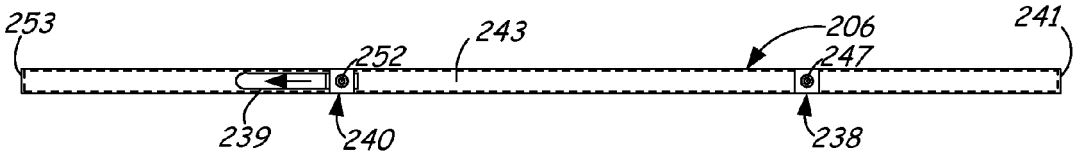

With reference back to FIG. 1, the top end 136 of magnet 130 magnetically couples to a portion of sign holder or frame member 102, which is inserted between longitudinal member 118 and 122. In addition, bottom end 127 of magnet 130 magnetically couples to a portion of support beam or bar 106, which is inserted between longitudinal members 118 and 122. In this configuration, the at least one bracket 104 holds the sign holder 102 above the underlying support beam 106 in a generally vertical orientation FIGS. 3A-3C illustrate an exploded perspective view, an assembled side view and an assembled bottom view of an alternative embodiment of a support beam or bar 206 and posts or legs 238 and 240 for a sign fixture, which may be used in place of beam 106 of FIG. 1. Metallic support beam 206 is a hollow beam or bar as illustrated by the dashed lines in FIGS. 3B and 3C and includes a first end 253, a second end 241, a top 242 and a bottom 243. As illustrated in FIG. 3C, bottom 243 of support beam 206 includes at least one aperture 239 extending along a portion of the bottom 243 of support beam 206.

In the embodiment illustrated in FIGS. 3A-3C, support beam 206 is supportable by and mates with an underlying product display structure via the pair of depending posts or legs 238 and 240. For example, the underlying product display structure (not illustrated) can include holes for receiving posts or legs 238 and 240. First post 238 includes a main section 244, a sub-section 245, a proximal end 246 and a distal end 247. Proximal end 246 and main section 244 are fixed to the bottom 243 of support beam 206 by, for example, welding. Distal end 247 and sub-section 245 are shaped to fit into a corresponding hole in an underlying product display structure.

Second post 240 includes a main section 248, a first sub-section 249, a second sub-section 250, a proximal end 251 and distal end 252. Proximal end 251 and second sub-section 250 are inserted through a center hole in a slide block or movable base 254 and fixed to the slide block by, for example, welding (see the dashed lines in FIG. 3B). Slide block 254 is located within hollow support beam 206 such that the proximal end 251 of post 240 is coupled to support beam 206 via the slide block 254 and extends from support beam 206 through aperture 239. Distal end 252 and first sub-section 249 are shaped to fit into a corresponding hole in an underlying product display structure. Therefore, post 240 is laterally adjustable (as illustrated by arrows in FIGS. 3B and 3C) along the portion of bottom 243 of support beam 206, which a length of aperture 239 extends. The adjustability of post 240 allows support beam 206 to be used with a variety of different product display structures having variable corresponding hole arrangements.

Figure 3D:
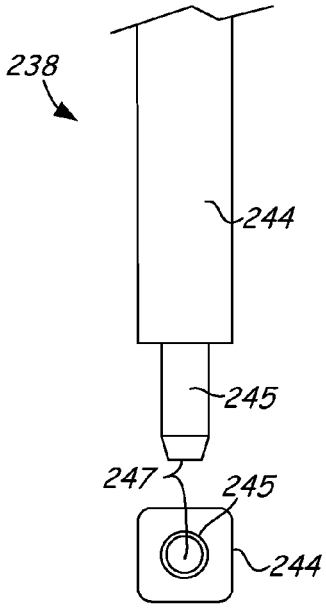
FIG. 3D illustrates side and bottom views of the post illustrated in FIGS. 3A-3C.
Figure 3E:
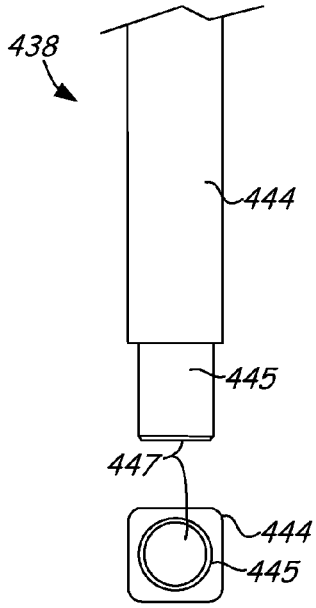
FIG. 3E illustrates side and bottom views of an alternative embodiment of the post illustrated in FIGS. 3A-3C.

FIG. 3D illustrates enlarged side and bottom views of post 238. FIG. 3E illustrates enlarged side and bottom views of an alternative embodiment of a post 438 having sub-section 445, main section 444 and distal end 447. Comparing FIGS. 3D and 3E, sub-section 445 and distal end 447 have larger widths than sub-section 244 and distal end 247.

Figure 4:
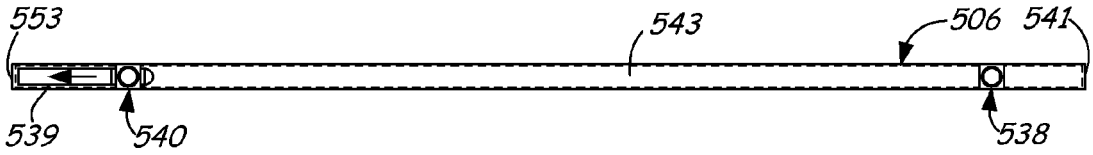
FIG. 4 illustrates an assembled bottom view of a support beam and posts of a sign fixture under one embodiment.

FIG. 4 illustrates an assembled bottom view of another alternative embodiment of a support beam 506 and posts or legs 538 and 540 for a sign fixture, which may be used in place of beam 106 of FIG. 1. Hollow support beam 506 having first end 553 and second end 541, and posts 538 and 540 are similar to support beam 206 and posts 238 and 240 of FIGS. 3A-3C. However, aperture 539 in the embodiment illustrated in FIG. 4 is located along a bottom 543 of support beam 506 at a location closer to first end 553 than the location of aperture 239 on support beam 206 with respect to first end 253. Therefore, adjustable post 540 is located closer to first end 553 than the location of post 240 is to first end 253. In addition, fixed post 539 is located closer to second end 541 than the location of post 241 is relative to second end 241.

Figure 5A:
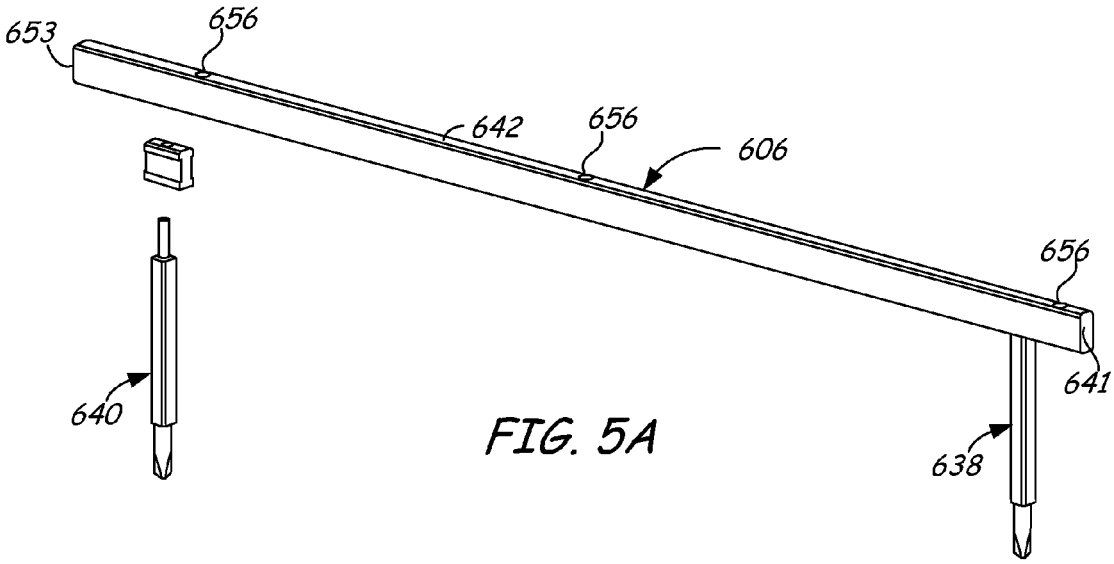
FIGS. 5A-5C illustrate an exploded perspective view, an assembled side view and an assembled bottom view of a support bar and posts of a sign fixture under one embodiment.
Figure 5B:
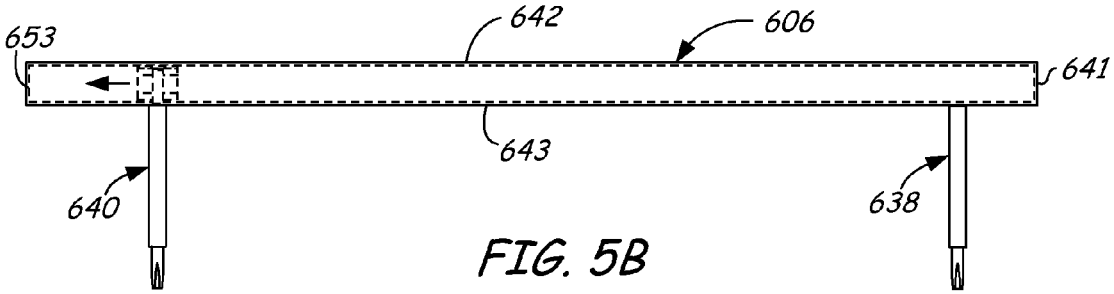
Figure 5C:
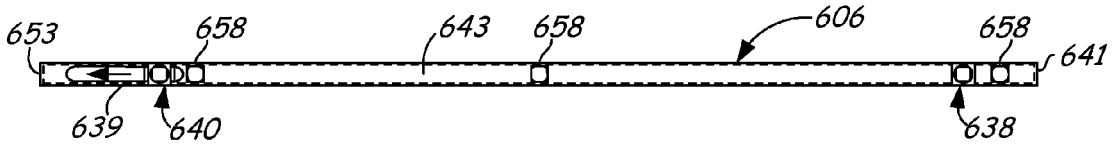

FIGS. 5A-5C illustrate an exploded perspective view, an assembled side view and an assembled bottom view of yet another alternative embodiment of a support bar 606 and depending posts 638 and 640 for a sign fixture, which may be used in place of beam 106 of FIG. 1. Similar to support beam 206 and 506, hollow support beam 606 includes a first end 653, a second end 641, a top 642 and a bottom 643. Hollow support beam 606, however, includes additional spaced apart holes 656 located through the top 642 of support beam 606 and additional spaced apart holes 658 through the bottom 643 of hollow support beam 606, where each rounded hole 656 is aligned with each squared hole 658. Holes 656 and 658 allow for additional signing to be mounted to support beam 606 besides the signing provided by the H-brackets and sign holder illustrated in FIG. 1. For example, a post having a sign can be inserted through rounded hole 656 and held in place through hardware accessible through squared hole 658.

Another difference between support beam 606 and support beams 206 and 506 includes the placement of aperture 639 along bottom 643 of support beam 606. In the embodiment illustrated in FIGS. 5A-5C, aperture 639 is located along bottom 643 at a location between the location of aperture 239 of support beam 206 and the location of aperture 539 of support beam 506. Therefore, adjustable post 640 is located closer to first end 653 than adjustable post 240 is to first end 253, but adjustable post 640 is located further from first end 653 than adjustable post 540 is to first end 553. In addition, fixed post 638 is located closer to second end 641 than fixed post 238 is to second end 241, but fixed post 638 is located further from second end 641 than fixed post 538 is to second end 541.

Figure 5D:
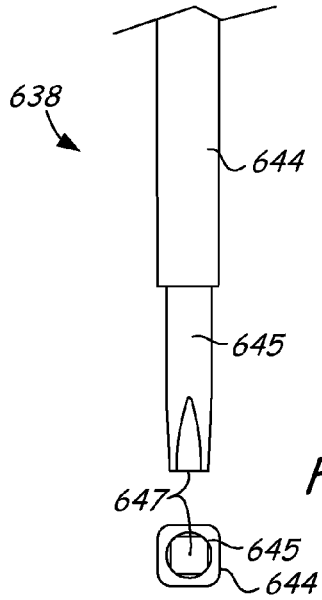
FIG. 5D illustrates side and bottom views of the post illustrated in FIGS. 5A-5C.

In yet another difference, post 638 has a different shape than posts 238 and 438 of FIGS. 3D and 3E. As illustrated in both the side and bottom views of post 638 in the enlarged illustration of FIG. 5D, distal end 647 and sub-section 645 has a different shape than the distal ends 247 and 447 and sub-sections 245 and 445 illustrated in FIGS. 3D and 3E. As shown in the bottom view of FIG. 5D, the distal end 647 of post 638 is squared instead of being rounded as found in the distal ends of posts 238 and 438 illustrated in FIGS. 3D and 3E.

Figure 6A:
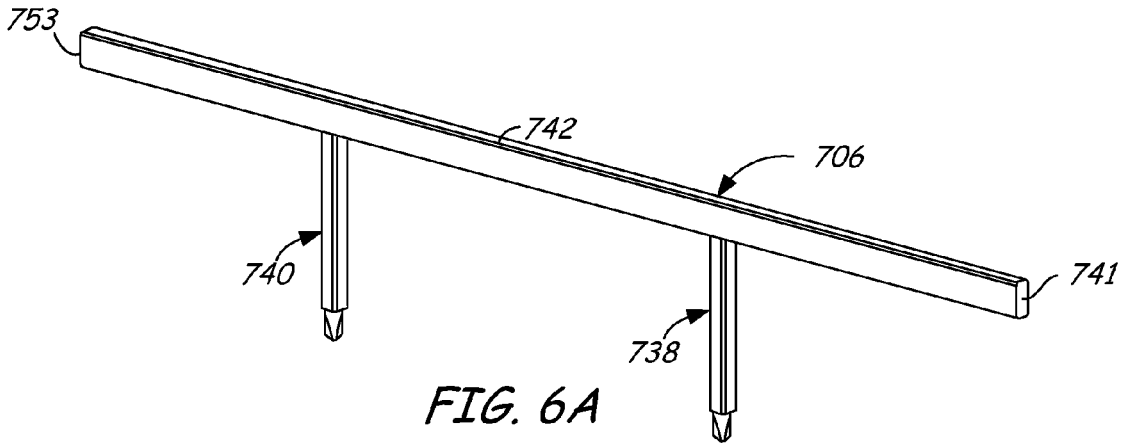
FIGS. 6A-6C illustrate a perspective view, a side view and a bottom view of a support beam and posts of a sign fixture under one embodiment.
Figure 6B:
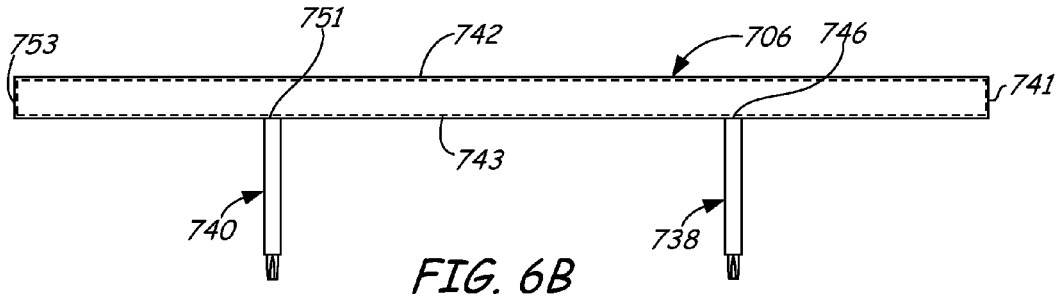
Figure 6C:
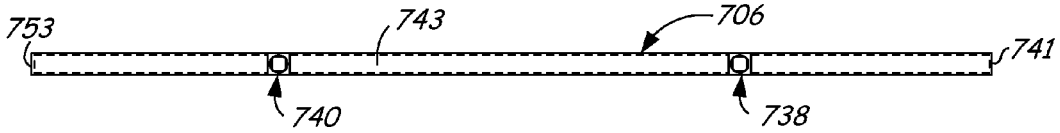

FIGS. 6A-6C illustrate a perspective view, a side view and a bottom view of yet another alternative embodiment of a support beam or bar 706 and posts or legs 738 and 740 for a sign fixture, which may be used in place of beam 106 of FIG. 1. Metallic support beam 706 is a hollow beam or bar as illustrated by the dashed lines in FIGS. 7B and 7C and includes a first end 753, a second end 741, a top 742 and a bottom 743.

In the embodiment illustrated in FIGS. 6A-6C, support beam 706 is supported by and mates with an underlying product display structure via the pair of depending posts or legs 738 and 740. For example, the underlying product display structure (not illustrated) can include holes for receiving posts or legs 738 and 740. First post 738 and second post 740 are similar to posts 638 and 640 in shape. However, both first and second posts 738 and 740 have proximal ends 746 and 751 (FIG. 6B) that are fixed to bottom 743 of support beam 706 by, for example, welding.

Figure 7A:
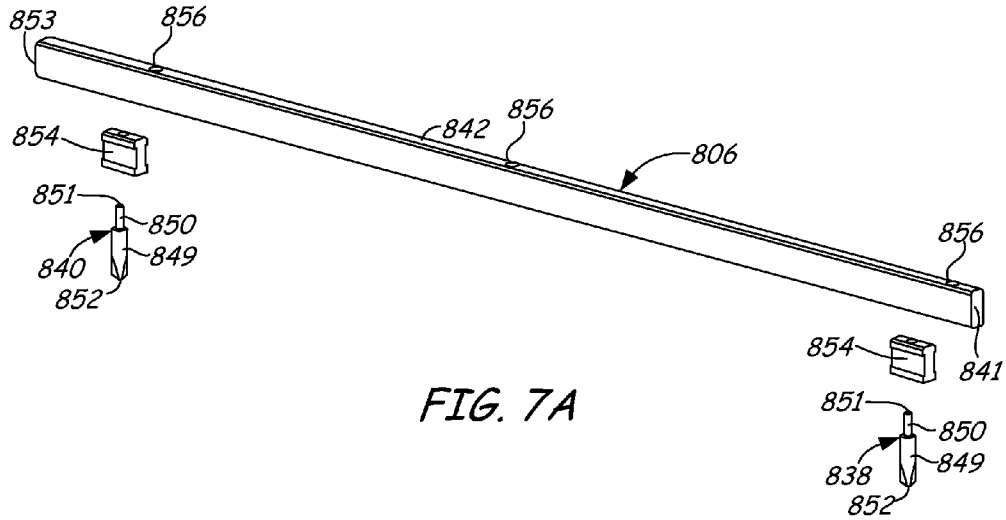
FIGS. 7A-7C illustrate an exploded perspective view, an assembled side view and an assembled bottom view of a support beam and posts of a sign fixture under one embodiment.
Figure 7B:
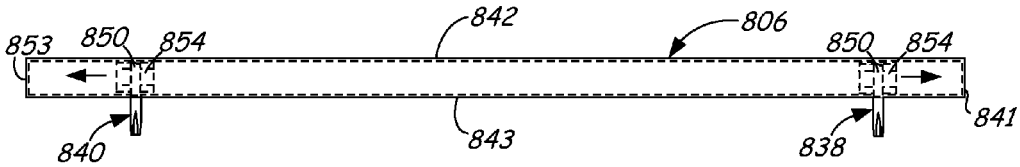
Figure 7C:
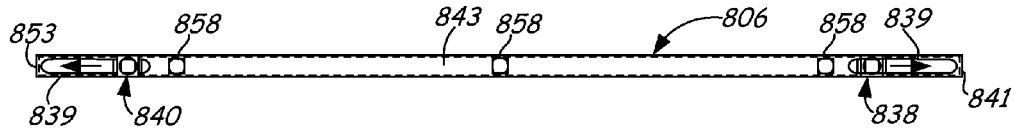

FIGS. 7A-7C illustrate an exploded perspective view, an assembled side view and an assembled bottom view of yet another alternative embodiment of a support beam or bar 806 and posts or legs 838 and 840 for a sign fixture, which may be used in place of beam 106 of FIG. 1. Metallic support beam 806 is a hollow beam or bar as illustrated by the dashed lines in FIGS. 7B and 7C and includes a first end 853, a second end 841, a top 842 and a bottom 843. As illustrated in FIG. 7C, bottom 843 of support beam 806 includes two apertures 839 extending along two different portions of bottom 843 of support beam 806.

In the embodiment illustrated in FIGS. 7A-7C, support beam 806 is supported by and mates with an underlying product display structure via the pair of depending posts or legs 838 and 840. For example, the underlying product display structure (not illustrated) can include holes for receiving posts or legs 838 and 840.

Unlike other posts illustrated in other embodiments, both first post 838 and second post 840 include a first section 849, a second section 850, a proximal end 851 and distal end 852. Proximal ends 851, which are part of second section 850 of both posts 838 and 840 are fixed to slide blocks or movable bases 854 by, for example, welding, as illustrated in dashed lines in FIG. 7B. Slide blocks 854 are located within hollow support beam 806 such that the proximal ends 851 of posts 838 and 840 are coupled to support beam 806 via the slide blocks 854 and extend from support beam 806 through each of the apertures 839. Therefore, both posts 838 and 840 are laterally adjustable (as illustrated by arrows in FIGS. 7B and 7C) along different portions of the bottom 843 of support beam 806 corresponding to the length apertures 839 extend. In other words, the adjustability of posts 838 and 840 allow support beam 806 to be used with a variety of different product display structures having variable corresponding hole arrangements.

Hollow support beam 806 also includes additional spaced apart holes 856 located through the top 842 of support beam 806 and additional spaced apart holes 858 on the bottom 843 of hollow support beam 806 similar to support beam 506 illustrated in FIGS. 5A-5C. Each rounded hole 856 is aligned with each squared hole 858. Holes 856 and 858 allow for additional signing to be mounted to support beam 806 besides the signing provided by the H-brackets and sign holder illustrated in FIG. 1. For example, a post having a sign can be inserted through rounded hole 856 and held in place through hardware accessible through squared hole 858.

Figure 8:
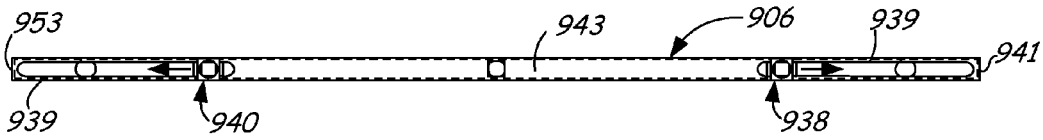
FIG. 8 illustrates an assembled bottom view of a support beam and posts of a sign fixture under one embodiment.

FIG. 8 illustrates an assembled bottom view of yet another alternative embodiment of a support beam 906 and posts or legs 938 and 940 for a sign fixture, which may be used in place of beam 106 of FIG. 1. Hollow support beam 906, having first end 953, second end 941, and posts 938 and 940 are similar to support beam 806 and posts 838 and 840 of FIGS. 7A-7C. However, apertures 939 in the embodiment illustrated in FIG. 8 extend along a bottom 943 of support beam 906 for a greater length than apertures 839 of FIG. 7C Therefore, adjustable posts 938 and 940 can be adjusted along a greater portion of support beam 906. In addition, two of the three bottom squared holes are missing because apertures 939 extend over where they would have been positioned.

Figure 9:
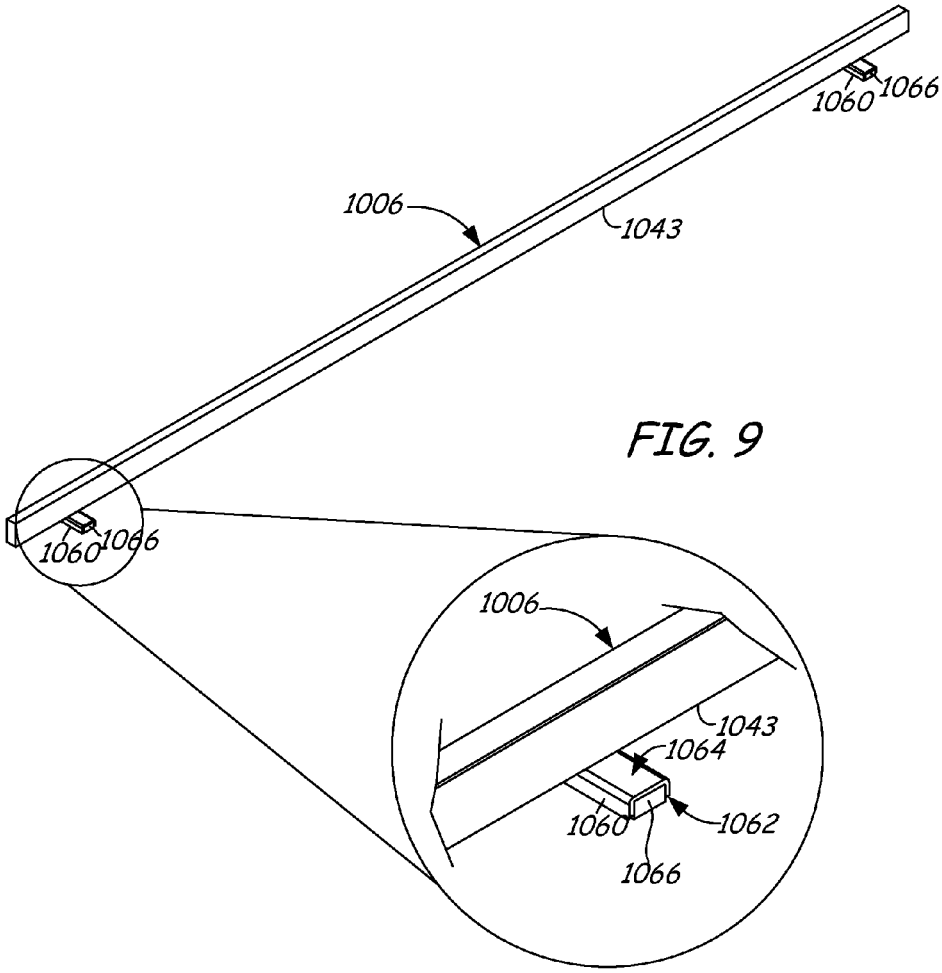
FIG. 9 illustrates a perspective view of a support bar of a sign fixture under one embodiment.

FIG. 9 illustrates a perspective view of yet another embodiment of a support beam 1006 for a sign fixture, which may be used in place of beam 106 of FIG. 1. Instead of depending posts coupled to a bottom 1043 of support beam 1006, a pair of channel members 1060 are fixed to the bottom 1043 of support beam 1006 by, for example, welding. Each channel member 1060 includes an open side 1062 and a closed side 1064. The closed side 1064 is fixed to bottom 1043 of support beam 1006. The open side 1062 is configured to hold and accommodate a magnet 1066 by, for example, an adhesive. Therefore, support beam 1006 is supported by and coupling to an underlying product display structure via magnet 1066.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A sign fixture comprising:

a support beam having a first end and a second end and being supported by a product display structure;

a sign holder for supporting a sign indicative of information related to a product displayed for sale;

at least one bracket comprising:

first and second longitudinal members having first and second ends and oriented in parallel with each other;

a lateral member having a top surface and a bottom surface attached to and extending between the first and second longitudinal members at a location between the first and second ends of the first and second longitudinal members;

wherein the at least one bracket includes a magnet having a top end and a bottom end, said magnet extending completely through said lateral member such that the top end of the magnet is exposed and aligned with the top surface of the lateral member and the bottom end of the magnet protrudes from the bottom surface of the lateral member; and wherein the sign holder is magnetically coupled to the top end of the magnet and the support beam is magnetically coupled to the bottom end of the magnet such that the at least one bracket couples the support beam to the sign holder.

2. The sign fixture of claim 1, further comprising a pair of legs having proximal ends for coupling to the support beam and distal ends for mating to the product display structure.

3. The sign fixture of claim 2, wherein the proximal end of at least one of the pair of legs is fixed to a bottom of the support beam.

4. The sign fixture of claim 2, wherein the support beam comprises a hollow support beam and at least one aperture extending along and through a portion of a bottom of the support beam.

5. The sign fixture of claim 4, wherein the proximal end of at least one of the pair of legs is coupled to a slide block located in the hollow support beam such that the at least one leg is laterally adjustable within the aperture extending along and through the portion of the bottom of the hollow support beam.

6. The sign fixture of claim 2, wherein the support beam comprises a hollow support beam and a first aperture extending along and through a first portion and a second aperture extending along and through a second portion of a bottom of the support beam.

7. The sign fixture of claim 6, wherein the proximal ends of the first leg of the pair of legs is coupled to a first slide block located in the hollow support beam and the proximal end of the second leg of the pair of legs is coupled to a second slide block located in the hollow support beam such that each leg of the pair of legs is laterally adjustable within one of the apertures extending along and through the first and second portions of the bottom of the hollow support beam.

8. The sign fixture of claim 1, further comprising a pair of channel members having a closed side fixed to a bottom of the support beam and an open side for accommodating a magnet, the magnet coupling the support beam to the product display structure.

9. A sign fixture comprising:

a hollow support bar having a top, a bottom, a first end and a second end and including at least one aperture extending along and through a portion of the bottom;

a pair of posts having proximal ends for coupling to the support bar and distal ends for coupling to a product display unit, wherein the proximal end of at least one of the pair of posts is coupled to a movable base located within the hollow support beam such that the at least one post is laterally adjustable within the aperture extending along and through the bottom of the hollow support bar;

a frame member for supporting a sign indicative of information related to a product displayed for sale; and at least one H-bracket having a magnet, the at least one H-bracket includes an upper channel and a lower channel, each of the upper channel and the lower channel of the at least one H-bracket being open on at least three sides, the upper channel receives a portion of the frame member, the lower channel receives a portion of the hollow support bar, wherein the H-bracket magnetically couples the hollow support bar to the frame member.

10. The sign fixture of claim 9, wherein the at least one H-bracket comprises:

first and second longitudinal elements oriented substantially in parallel with each other and having first and second ends; and a lateral element attached to and extending between the first and second longitudinal elements at a location between the first and second ends, the lateral element having a top surface and a bottom surface.

11. The sign fixture of claim 10, wherein the magnet of the H-bracket extends through a thickness of the lateral element and has a top end and a bottom end, the top end of the magnet exposed to and aligned with the top surface of the lateral element and the bottom end of the magnet protruding from the bottom surface of the lateral element.

12. The sign fixture of claim 11, wherein the top end of the magnet magnetically couples to a lower portion of the frame member, the lower portion of the frame member inserted between the first and second longitudinal elements, the lower portion of the frame member is disposed above the lateral member.

13. The sign fixture of claim 11, wherein the bottom end of the magnet magnetically couples to an upper portion of the hollow support bar, the upper portion of the hollow support bar inserted between the first and second longitudinal elements, the upper portion of the hollow support bar is disposed below the lateral member.

14. The sign fixture of claim 9, wherein the at least one aperture extending along and through a portion of the bottom of the hollow support bar comprises a first aperture extending along and through a first portion and a second aperture extending along and through a second portion of the bottom of the hollow support bar.

15. The sign fixture of claim 14, wherein the proximal ends of both of the pair of posts are each coupled to separate movable bases located in the hollow support bar such that each of the pair of posts is laterally adjustable within its respective aperture extending along and through the bottom of the support bar.

16. A sign fixture comprising:

a support beam having a first end and a second end and supported by a product display structure;

a sign holder for supporting a sign indicative of information related to a product displayed for sale; and first and second H-brackets, each H-bracket including a magnet, the magnet of the first H-bracket exerting a magnetic coupling force on a first portion of the support beam and on a first portion of the sign holder and the magnet of the second H-bracket exerting a magnetic coupling force on a second portion of the support beam and on a second portion of the sign holder whereby the magnet of the first H-bracket and the magnet of the second H-bracket magnetically couple the sign holder to the support beam, the first and second H-brackets each include first and second channels, each of the first and second channels are open on three sides.

17. The sign fixture of claim 16, further comprising a pair of legs having proximal ends for coupling to the support beam and distal ends for coupling to the product display structure.

18. The sign fixture of claim 17, wherein the proximal end of at least one of the pair of legs is fixed to a bottom of the support beam.

19. The sign fixture of claim 17, wherein the support beam comprises a hollow support beam and at least one aperture extending along and through a portion of a bottom of the support beam.

20. The sign fixture of claim 19, wherein the proximal end of at least one of the pair of legs is coupled to a slide block located in the hollow support beam such that at least one leg of the pair of legs is laterally adjustable within the aperture extending along and through the bottom of the hollow support beam.

* * * * *